United States Patent [19]

Apeland

[11] Patent Number: 4,707,249

[45] Date of Patent: Nov. 17, 1987

[54] SAND CLASSIFICATION TANK

[76] Inventor: Ivar Apeland, N-4137 Årdal, Norway

[21] Appl. No.: 706,724

[22] Filed: Feb. 28, 1985

[30] Foreign Application Priority Data

Mar. 13, 1984 [NO] Norway ..... 840942

[51] Int. Cl.[4] ..... B03B 5/62; B07C 5/14

[52] U.S. Cl. ..... 209/156; 209/208; 210/521; 210/525

[58] Field of Search ..... 210/521, 552, 523, 525, 210/526, 530, 532, 109, 540, 532.1; 209/156, 17, 208, 209, 490, 491, 492, 494, 495, 496, 461, 446

[56] References Cited

U.S. PATENT DOCUMENTS

| | | | |
|---|---|---|---|
| 749,706 | 1/1904 | Storey | 209/437 |
| 1,044,845 | 11/1912 | Argall | 209/208 |
| 1,167,638 | 1/1916 | Edison | 209/208 |
| 1,431,367 | 10/1922 | Büchi | 210/532.1 |
| 1,530,592 | 3/1925 | Bradley | 209/208 |
| 3,160,321 | 12/1964 | Cochran | 209/208 |
| 3,262,560 | 7/1966 | Lillig et al. | 209/156 |
| 4,184,955 | 1/1980 | Arvanitakis | 210/521 |
| 4,338,195 | 7/1982 | Treyssac | 210/521 |
| 4,416,764 | 11/1983 | Gikis et al. | 210/523 |
| 4,536,286 | 8/1985 | Nugent | 210/521 |

FOREIGN PATENT DOCUMENTS

| | | | |
|---|---|---|---|
| 615054 | 2/1961 | Canada | 210/525 |
| 2432109 | 1/1976 | Fed. Rep. of Germany | 210/781 |
| 326294 | 5/1903 | France | 209/492 |
| 158763 | 12/1979 | Japan | 209/155 |
| 336587 | 10/1930 | United Kingdom | 209/208 |
| 2055309 | 3/1981 | United Kingdom | 209/209 |
| 1003934 | 3/1983 | U.S.S.R. | 209/208 |

*Primary Examiner*—S. Leon Bashore
*Assistant Examiner*—Thomas M. Lithgow
*Attorney, Agent, or Firm*—Schwartz, Jeffery, Schwaab, Mack, Blumenthal & Evans

[57] ABSTRACT

In a sand classification tank for producing classified sand for concrete pouring purposes, i.e., sand containing predetermined fractions of sand grains of different sizes per unit of volume, a mixture of unclassified sand and water is introduced into a tank (1) partially filled with water, beneath the surface of the water, and the sand grains are deposited by sedimentation at the bottom of the tank at varying distances from the inlet, depending on their weight, such that the coarsest sand fraction will be deposited closest to, and the finest fraction or fines farthest from, the place where the sand-/water mixture is introduced into the tank. For the purpose of retaining as much of the fines fraction as possible (i.e., sand grains of between 0.002 and 0.006 mm) as well as coarser sand fractions that are larger than conventional equipment can handle (up to about 12 mm), in order thereby to obtain a substantial savings of cement and substantially improved castability of the concrete as well as to reduce the water requirement considerably, the classification tank (1) is defined at the bottom thereof by a plurality of successive compartments (8,8*a*) each associated with one or more screw conveyors (9) for carrying off the sand from the respective compartments, said compartments (8,8*a*) communicating with the remainder of the tank (1) through slots (10) that preferably are adjustable.

5 Claims, 6 Drawing Figures

SAND CLASSIFICATION TANK

BACKGROUND OF THE INVENTION

1. Field of the Invention

The present invention relates to a sand classification tank for producing classified sand, i.e., sand containing specific and predetermined fractions of differently-sized sand grains per unit of volume.

2. Related Art

Conventional equipment for classifying sand for use in pour concrete comprises a tank partially filled with water, and a mixture of sand and water is introduced into the tank below the surface of the water through a feed inlet. The grains of sand follow a natural current of flow through the tank. The sand is deposited as a sediment at the bottom of the tank, the sedimentation being determined by gravity according to the weight of the various grains. Thus, the sand is deposited along the length of the tank, the coarsest sand fraction being deposited closest to the feed inlet and finer particles farther downstream. The finest fraction, which is called "fines", is deposited farthest from the feed inlet—assuming that these particles are able to settle at all, being very buoyant and thus not readily sinking to the bottom of the tank. In the prior art sand classification tanks, the various sand fractions are metered out through hydraulically operated valves at the bottom of the tank, in the form of plate valves. Excess water usually has to be drained off in order to facilitate further transport of the sand fractions, so the mass leaving the tank normally passes over dewatering wheels and the like. Before the unclassified sand enters the tank, it passes through a sieve which holds back larger particles. The prior art systems cannot handle particles of larger diameter than about 5 mm. Sand grains that are larger than this, for example 10 mm in diameter, may cause serious damage to the prior art equipment, because if these particles manage to penetrate between the bottom of the tank and the valve at the bottom, the valve will not operate properly and a permanent water leakage results.

Recent research has shown that a substantial savings of cement and a better concrete are obtained if the classified sand contains a controlled amount of fines, i.e., grains of sand between about 0.002 and 0.006 mm in size. It is also desirable to increase the diameter of the coarsest fraction up to a grain size of about 12 mm diameter.

The prior art systems cannot handle sand grains larger than about 5 mm owing to the risk of leakage through the bottom valves. Another drawback of prior art classification tanks is that a considerable proportion of the fines is washed away during the process, being drained off together with the waste water. This occurs when the bottom valves are opened for conducting the mass down to the dewatering wheel—which, it might be added, is an expensive structural component. When the mixture of water and sand reaches the dewatering wheel, the resulting turbulence causes some of the fines to be washed out in the overflow water. Known equipment of this type also requires vast amounts of water to function, on the order of 3,000–4,000 liters/minute.

OBJECT AND SUMMARY

The primary object of the invention is to alleviate the drawbacks of known classification tanks, providing a tank in which a larger percentage of the fines is retained, while at the same time the water requirement is reduced. In addition, the classification tank of the invention makes it possible to increase the maximum diameter of the sand grains to about 10–12 mm.

This is obtained in accordance with the invention.

In a sand classification tank for producing classified sand for concrete pouring purposes, i.e., sand containing predetermined fractions of sand grains of different sizes per unit of volume, a mixture of unclassified sand and water is introduced into a tank partially filled with water, beneath the surface of the water, and the sand grains are deposited by sedimentation at the bottom of the tank at varying distances from the inlet, depending on their weight, such that the coarsest sand fraction will be deposited closest to, and the finest fraction or fines farthest from, the place where the sand/water mixture is introduced into the tank. For the purpose of retaining as much as the fines fraction as possible (i.e., sand grains of between 0.002 and 0.006 mm) as well as coarser sand fractions that are larger than conventional equipment can handle (up to about 12 mm), in order thereby to obtain a substantial savings of cement and substantially improved castability of the concrete as well as to reduce the water requirement considerably, the classification tank is defined at the bottom thereof by a plurality of successive compartments each associated with one or more screw conveyors for carrying off the sand from the respective compartments, said compartments communicating with the remainder of the tank through slots that preferably are adjustable.

By utilizing adjustable slots instead of circular bottom valves, the build-up of "artificial" hill of sand at the bottom of the tank is avoided, which gives rise to inaccurate sand classification curves due to doming effects. The use of screw conveyors for conducting and metering out the sand from the tank has proved to be especially advantageous, especially for the finer sand fractions and in particular for the fines. The screw conveyors can be utilized in such way that separate dehydrating equipment, such as expensive dewatering wheels, can be avoided entirely. Moreover, a sharper line of differentiation between the classification curves for the various fractions is obtained with the invention. Experiments have shown that the water consumption with the system of the invention can be reduced to about one-third of the conventional usage, or to about 1250 liters/-minute.

BRIEF DESCRIPTION OF THE DRAWINGS

An exemplary embodiment of the invention is schematically illustrated in the accompanying drawings, wherein.

DETAILED DESCRIPTION

Figure 1:
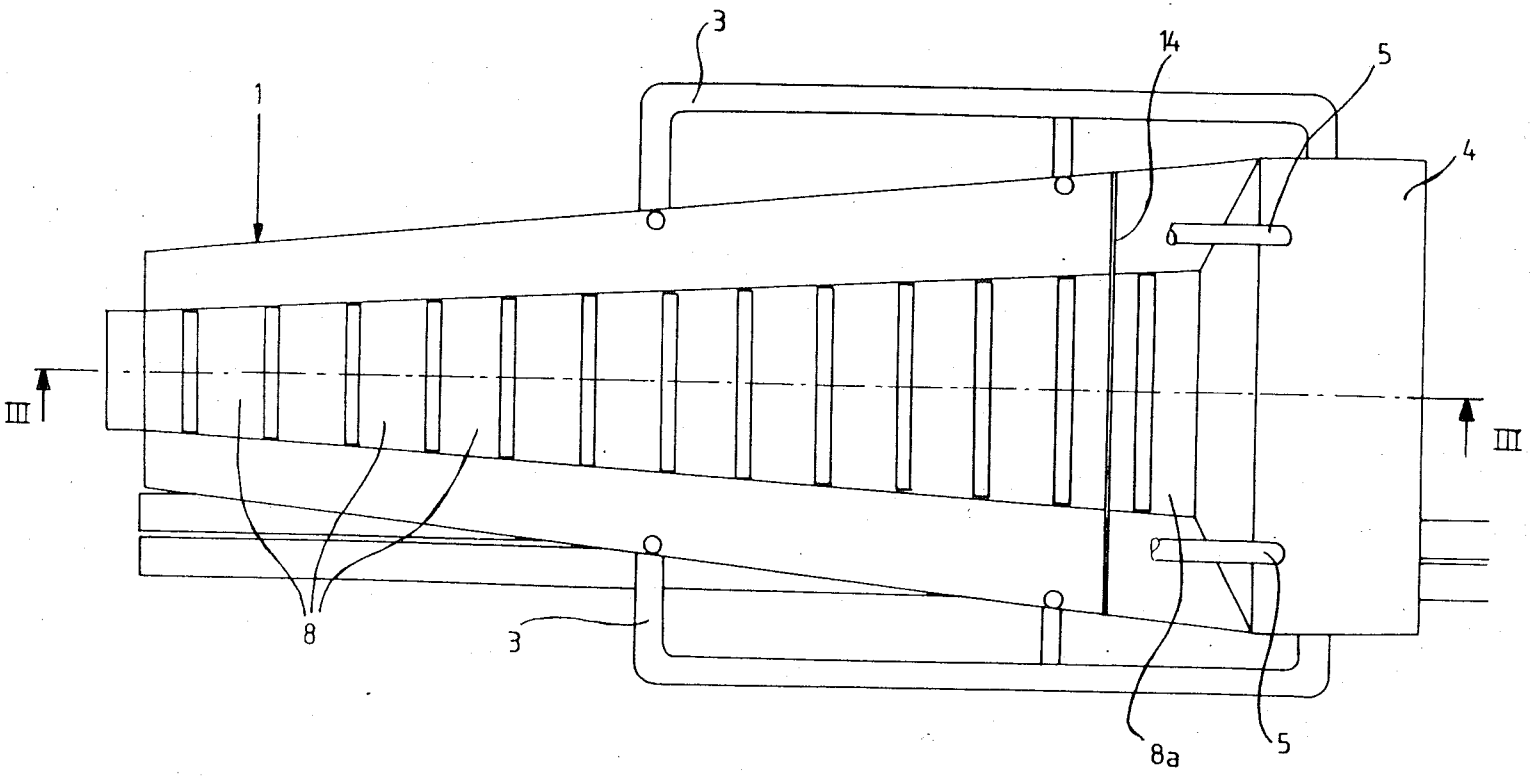
FIG. 1 shows a classification tank in accordance with the invention in plan view, for above.
Figure 2:
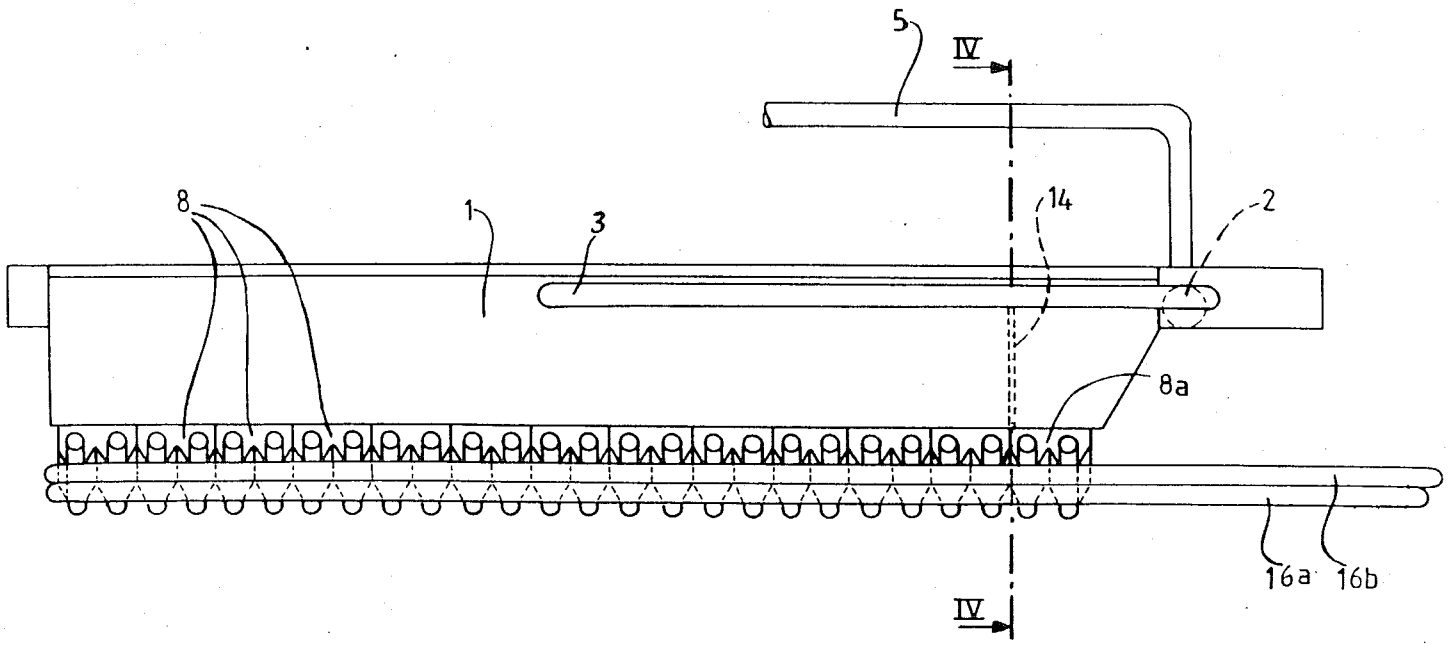
FIG. 2 shows the tank of FIG. 1 in side view.
Figure 3:
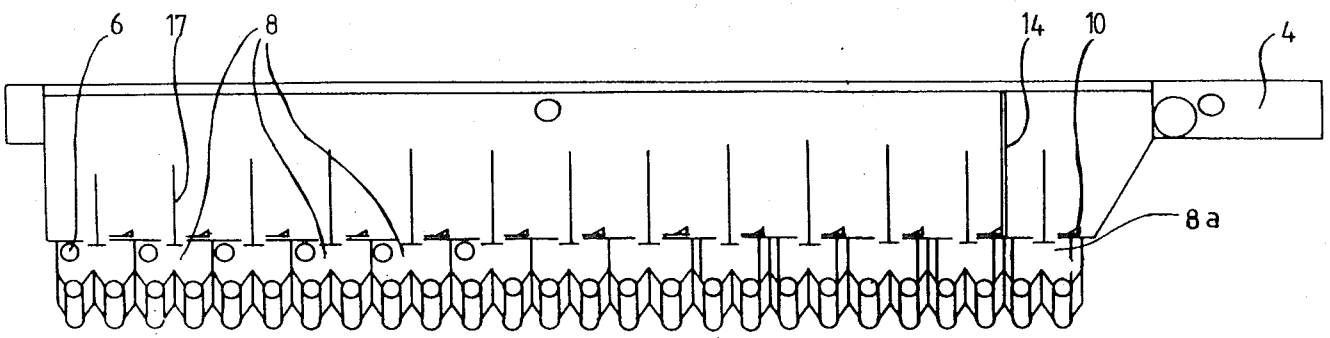
FIG. 3 is a longitudinal section of the tank on the line III—III in FIG. 1.

The drawings show a classification tank 1 which structurally may be of a construction known per se, but which has a bottom wall formed as a truncated V. The tank is provided with a thickener pump 2, and a pipe 3 for carrying overflow water from the tank 1 to a sump 4. There are pipes 5 for conducting return water from the sump 4 to the tank's inlet pipe (not shown), and pipes 6 for carrying return water from the sump 4 to the bottom section of the tank. A drainage channel 7 is also provided. A mixture of unclassified sand and water is introduced at a certain rate below the surface of the water in the tank 1, as schematically indicated in FIG. 2 (mass entering). Depending on their weight, the grains of sand sink to the bottom of the tank at increasing distances from the inlet, the coarsest fraction, in this case containing grains of sand with a diameter of about 12 mm, settling closest to the place of introduction and the fines (diameter between about 0.002 and 0.006 mm) being deposited (at 8*a*) farthest away from the place of introduction.

The classification tank 1 is formed with smooth (intermediate) walls and is defined at the bottom by a plurality of successive compartments 8,8*a*, wherein the latter compartment 8*a* is specially formed for receiving the fines fraction.

In conjunction with each compartment 8,8*a*, one or more (two in the example shown) screw conveyors 9 are provided (see FIG. 5 in particular) for carrying off the sand from the respective compartments.

Figure 6:
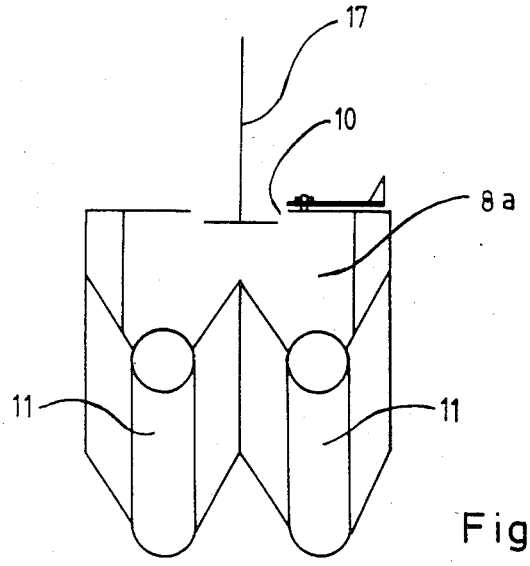
FIG. 6 shows the fines compartment portion of FIG. 3, drawn on a substantially larger scale.

The compartments 8,8*a* communicate with the remaining, overlying part of the tank 1 through transverse slots 10, which are preferably mechanically adjustable, as indicated schematically in FIG. 6.

Figure 4:
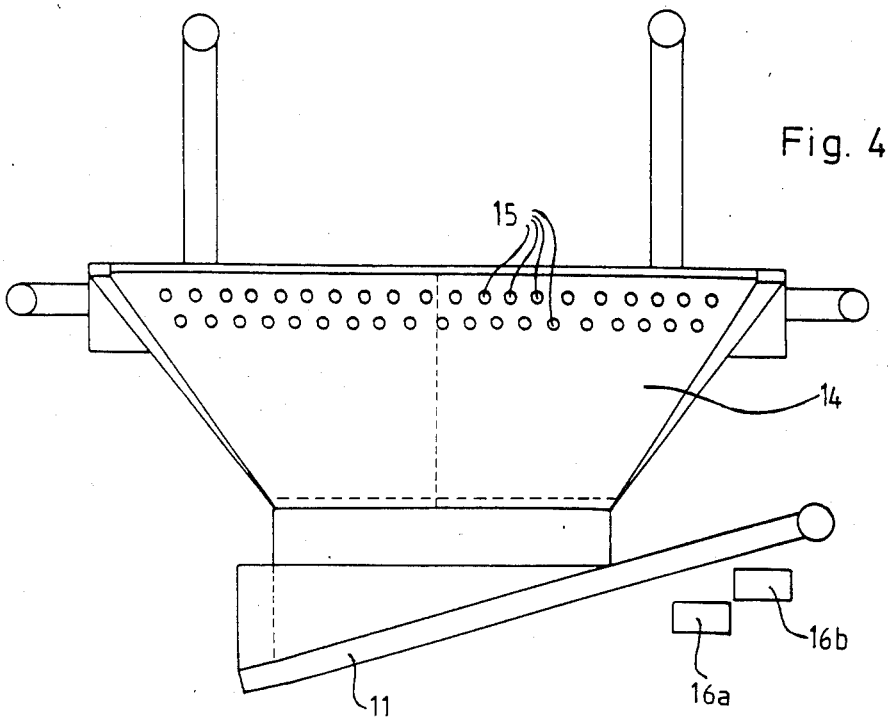
FIG. 4 shows a cross section of the tank on the line IV—IV in FIG. 2.
Figure 5:
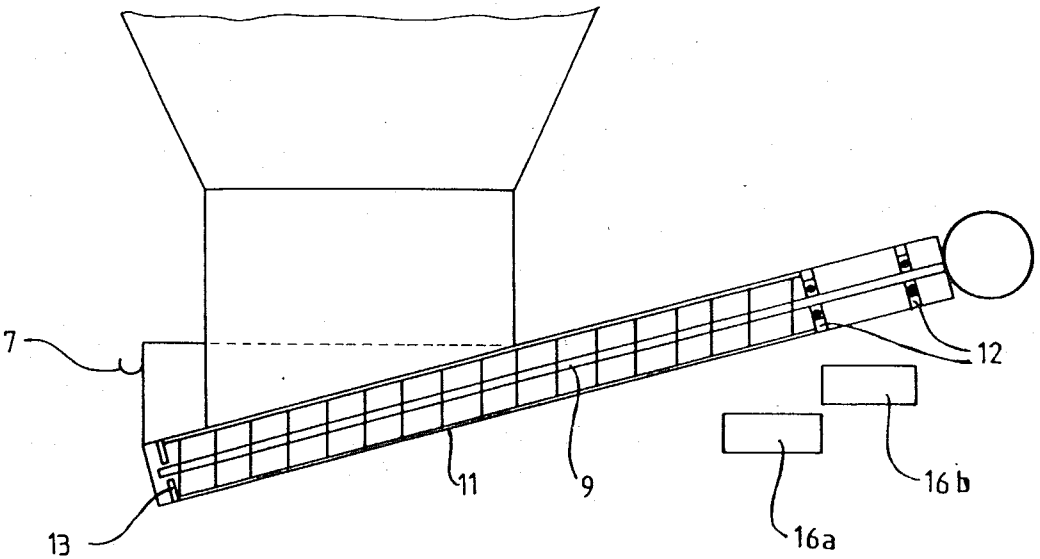
FIG. 5 is similar to FIG. 4 but drawn on a somewhat larger scale, showing a bottom channel containing the screw conveyor, in cross-sectional view.

As seen in FIG. 6, each compartment 8,8*a* has a W-configuration, in that two rounded bottom channels 11, disposed symmetrically relative to the axis of the compartment, are arranged on an upward incline as seen in FIGS. 4 and 5. The screw conveyors 9 are mounted within these channels 11. The actual bearing 12 for the screw 9 is arranged near the upper end thereof, see FIG. 5, and the lower end of the screw is merely supported by a simple guide means 13. The inclined position of the screw conveyors 9 promotes drainage of excess water from the mass as it is transported upwardly, and by utilizing a simple guide means 13 instead of bearings at the lower end of the screw 9, fines are prevented from penetrating into the screw bearings.

In the example illustrated herein, thirteen underlying compartments 8,8*a* are shown, and the compartment 8*a* located farthest away from the inlet for the sand/water mixture is intended to collect the fines. To facilitate a turbulence-free environment in this compartment 8*a*, a vertical, transversely-diposed baffle 14 is provided which helps to eliminate eddy currents in this area. As seen in FIG. 4, the baffle may be formed by two parallel plates both of which have perforations in the upper portion thereof. By moving the plates in relation to each other, the degree of overlap of the respective holes and solid plate portions intermediate the holes may be adjusted, thereby enabling one to regulate the flow of water into the compartment 8*a* so as to facilitate sedimentation of the fines.

Each compartment 8,8*a* is preferably provided with two screw conveyors 9. One of the screws serves to transport a fraction of particular size sand up to a conveyor belt 16*a*, and these screw conveyors can be computer-controlled for correct dosage of the respective sand fractions. The second screw conveyor 9 in each compartment 8,8*a* is intended to carry off surplus sand. This may be necessary when too high a proportion of a particular size sand grain is present in the sand/water mixture that has been introduced into the tank. The surplus of this size grain must be removed from the compartment when the compartment becomes full. To facilitate this, sand level sensors in the form of (slowly) rotating plate-like members 17 are provided, whose rotation is adapted to be stopped by friction with the upper layer of sand if the compartment is full. When a level sensor 17 is caused to stop, the screw conveyor for surplus sand is activated for carrying off the sand in the compartment in question. The surplus sand is removed on the second conveyor belt 16*b*.

I claim:

1. A sand classification tank for producing classified sand, i.e., sand containing predetermined fractions of sand grains of different sizes per unit of volume, comprising:

(a) an elongated tank having end walls and a bottom wall partially filled with water;

(b) introduction means at a first end wall for introducing a mixture of raw unclassified sand and water at a predetermined rate beneath the surface of the water in the partially filled tank thereby defining a sand flow direction toward a second end wall and depositing the grains of sand as a sediment at the bottom of the tank at varying distances from the introduction means, depending on the weight of the grains, such that the coarsest sand fraction will settle closest to the place of introduction while the finest fraction will be deposited farthest away from the introduction means;

(c) the classification tank further comprising bottom means defining a plurality of successive compartments said, bottom means being connected to said bottom wall and located so as to receive different grain sizes of sand;

(d) each compartment communicating with at least one screw conveyor means for carrying off the deposited sand, said compartments further communicating with the remainder of the tank through a plurality of slots;

(e) one of said compartments being the farthest from the introduction means adapted to receive the finest fraction;

(f) immediately upstream of the farthest compartment a baffle means is adjustably mounted transverse to the longitudinal direction of the tank and the direction of flow of the sand, said baffle means facilitating the precipitation of the finest fraction in said farthest compartment;

(g) said baffle means being formed by two parallel plates having perforations at the upper portion thereof, providing means for permitting the flow of water into the farthest compartment and being regulated by movement of the plates relative to each other for adjusting the degree of overlap of the respective holes therein.

2. A sand classification tank according to claim 1, wherein the at least one screw conveyor means comprises two screw conveyors which are provided in connection with each compartment, characterized in that one of said screw conveyors is adapted to transport a particular size sand and the second screw conveyor to transport surplus sand, the screw conveyor for surplus sand being adapted to be actuated when the associated compartment is so full that is must be emptied, said screw conveyors being adapted to cooperate with sand level sensors in the form of slowly rotating plate-like members the rotation of which will be stopped by friction between the plate-like member and the sand when the sand fills the compartment.

3. A sand classification tank according to claim 1, wherein the at least one screw conveyor means are disposed at an incline whereby the screw conveyor means conduct the respective sand fractions from their associated compartments in an upward direction, for delivery to a conveyor belt.

4. A sand classification tank according to claim 3, wherein the at least one screw conveyor means comprises bearings and said bearings are located at the upper end of each screw, while the lower end of each screw is supported by a simple guide means.

5. A sand classification tank according to claim 1, characterized in that the bottom wall of the tank has a truncated V-configuration.

* * * * *